US006278072B1

(12) United States Patent
Nakajo

(10) Patent No.: US 6,278,072 B1
(45) Date of Patent: Aug. 21, 2001

(54) SHEET-LIKE KEY TOP

(75) Inventor: Masaru Nakajo, Tokyo (JP)

(73) Assignee: Polymatech Co., Ltd. (JP)

( * ) Notice: Subject to any disclaimer, the term of this patent is extended or adjusted under 35 U.S.C. 154(b) by 0 days.

(21) Appl. No.: 09/650,457

(22) Filed: Aug. 29, 2000

(30) Foreign Application Priority Data

Sep. 13, 1999 (JP) ..... 11-258166

(51) Int. Cl.[7] ..... H01H 13/70

(52) U.S. Cl. ..... 200/341; 200/5 A; 200/314; 200/517

(58) Field of Search ..... 200/5 A, 511, 200/512, 517, 313, 314, 341, 345

(56) References Cited

U.S. PATENT DOCUMENTS 5,234,744 * 8/1993 Kenmochi ..... 428/195
5,399,821 * 3/1995 Inagaki et al. ..... 200/341
5,807,002 * 9/1998 Tsai ..... 400/494
6,023,033 * 2/2000 Yagi et al. ..... 200/512
6,103,346 * 8/2000 Nakajo et al. ..... 428/172

FOREIGN PATENT DOCUMENTS 2-14726 1/1990 (JP) ..... H01H/13/06
6-44859 2/1994 (JP) ..... H01H/13/06

* cited by examiner

*Primary Examiner*—Michael Friedhofer
(74) *Attorney, Agent, or Firm*—McGlew and Tuttle, P.C.

(57) ABSTRACT

A high-yield, high-quality sheet-like key top wherein a protective film is laminated to the backside of a display layer during the forming of a key top consisting of thermoplastic resin to preclude the pressure and the heat of the molten resin from directly affecting the display layer, thereby preventing the display portion from being distorted and the display layer from being cracked.

19 Claims, 4 Drawing Sheets

(a)

(b)

(a)

(b)

(a)

(b)

SHEET-LIKE KEY TOP

FIELD OF THE INVENTION

The present invention relates to a sheet-like key top used for pushbutton switches for equipment such as electronics, portables, and remote controls.

PRIOR ART

The construction of pushbutton switches used for the input portion of equipment such as electronics and portables has been diversified into a wide variety of designs. For example, pushbutton switches comprising key tops made from synthetic rubber, pushbutton switches in which key tops made from resin and key pads made from synthetic rubber are integrally attached together, and pushbutton switches in which a film is integrally attached to one surface of each key top made from resin are widely used. Above all, there has been an increasing demand for pushbutton switches in which a film is integrally attached to one surface of each key top made from resin, since in the case of switches of this type, a rich variety of display layers can be designed, the thickness can be made small, and prices are low.

The construction of a pushbutton switch in which a film is integrally attached to one surface of a key top made from resin is mentioned in the Japanese Patent Gazette Laid-Open No. HEI 2-14726. The above-mentioned construction is such that a film, on the back of which is present a display layer formed by printing, is deformed by bending to the same form as that of the key top main body and is integrally attached to the upper side of the key top. Furthermore, by way of one of the methods of manufacturing the above-mentioned key top is described in the Japanese Patent Gazette Laid-Open No. HEI 6-44859 a manufacturing method whereby a film having a printed display layer is firmly held by means of a mold for forming key top main bodies, and is deformed by the action of the pressure and the heat of the molten resin which are generated during the forming of the key top, thus being pushed upward, then is removed from the mold after the molten resin is cured.

However, a pushbutton switch in which a film is integrally attached to one surface of a key top made from resin has had a problem in that the display layer softens by the action of the pressure and the heat of the molten resin generated during the forming of thermoplastic resin, resulting in the display portion 2 for characters, symbols, and the like being liable to get distorted or in a crack 6 being liable to occur in the display layer 3, as shown in FIG. 2.

Furthermore, there has been another problem in that in a case where a metallic-looking display layer with metal filler mixed is present, the display layer softens by the action of the pressure and the heat of the molten resin generated during the forming of thermoplastic resin, resulting in an uneven dispersion 7 being liable to occur, as shown in FIG. 5.

SUMMARY OF THE INVENTION

For the purpose of solving the above-mentioned problems, the present invention provides a high-yield, high-quality sheet-like key top in which a protective film is laminated to the backside of the display layer so that the heat of the molten resin generated during the forming of thermoplastic resin will not directly affect the display layer, thereby preventing display portion from being distorted and the display layer from being cracked.

Namely, the present invention provides a sheet-like key top constructed such that a base film equipped with a display layer on its backside which is formed to the same shape as that of the upper surface of a main body of the key top is integrally attached to the main body of key top, wherein a protective film is laminated to the backside of the display layer.

PREFERRED EMBODIMENTS OF THE INVENTION

Any and every flexible, heat-resistant film may be used as a protective film of the present invention. For example, polyethylene terephthalate (PET) films, polyamide films, polycarbonate films, and fluorine films may be enumerated. Furthermore, any protective film with a thickness of 15 $\mu$m or more is capable of protecting a display layer from molten resin.

Reference being had to drawings, typical embodiments of the present invention are explained.

DESCRIPTION OF THE INVENTION

The manufacturing method whereby a protective film of the present invention is laminated is not specifically limited. For example, after a display layer has been formed on a base film, a protective film coated with an adhesive layer may be laminated to one surface of the display layer, thereby accomplishing lamination.

Embodiments of the present invention are mentioned below for more detailed explanations.

Embodiment 1

Figure 3:
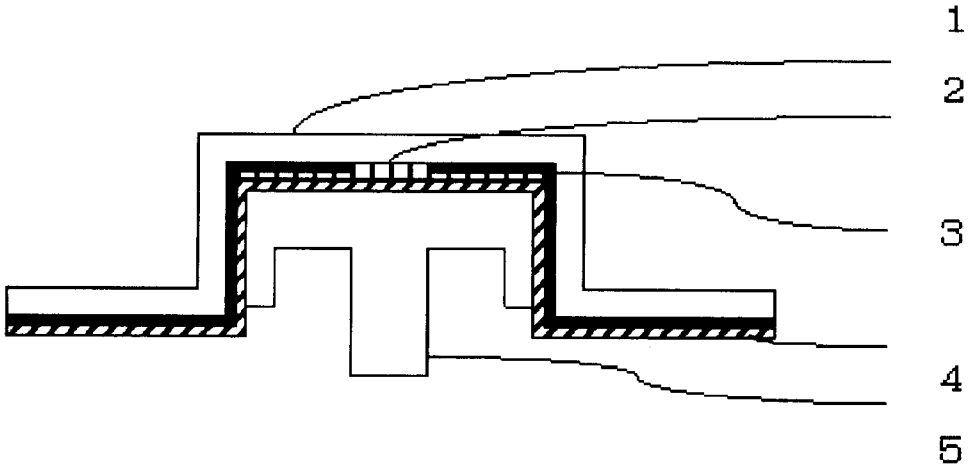
FIG. 3: (a) shows a longitudinal sectional view and (b) shows a top view of an embodiment of a sheet-like key top of the present invention.
Figure 3:
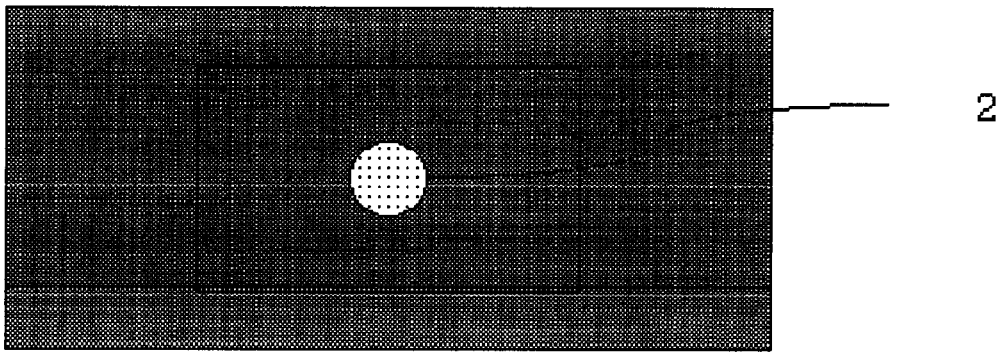

As shown in FIG. 3, the whole of one surface of a polycarbonate film 1 with a thickness of 100 gm was printed in vinyl chloride or vinyl acetate base black shading ink except for the portion to be printed with lettering, and a display portion 2 was printed on the above-mentioned lettering portion in vinyl chloride or vinyl acetate base colored translucent ink, thereby forming a display layer 3. A protective film 4, which was a 20 $\mu$m thick PET film with one surface coated with acrylic base adhesive compound, was laminated to that side where the display layer 3 was formed, thereby creating a film lamination. This film lamination was deformed to the shape of the key top by means of a mold for temporary drawing, and then was firmly held by means of a mold for injection molding. Thereafter, polycarbonate resin was injected onto the above-mentioned film lamination to produce a sheet-like key top in which five key top main bodies 5 were formed. Thus was obtained a high-quality sheet-like key top in which the display portion was not distorted and the display layer was not cracked, thereby preventing illumination leakage.

Embodiment 2

Figure 4:
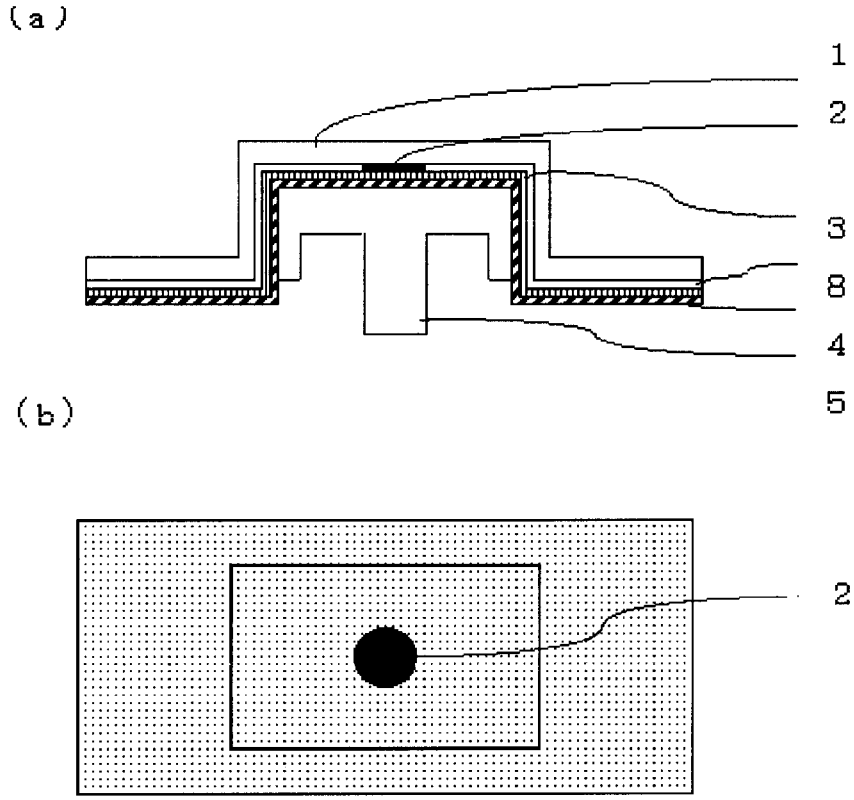
FIG. 4: (a) shows a longitudinal sectional view and (b) shows a top view of an embodiment of a sheet-like key top of the present invention.
Figure 5:
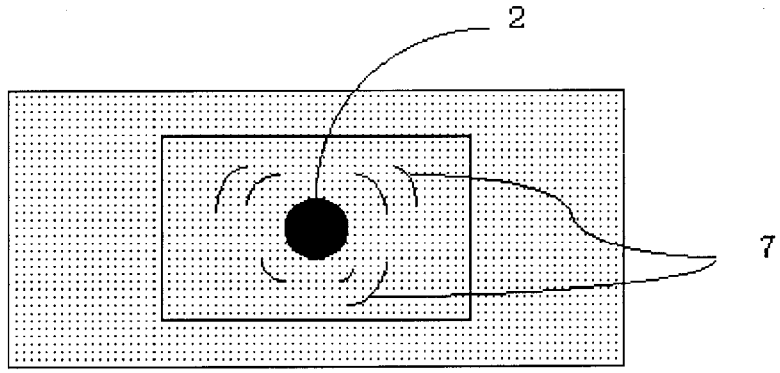
Fig. 5 PRIOR ART
FIG. 5 shows a top view of a prior art metallic-looking sheet-like key top.

As shown in FIG. 4, a thin film layer was formed, by means of deposition, on one surface of a 70 μm thick PET film, which was chosen as a protective film 4, and then was coated with an epoxy base deposited protective layer. Thereafter, a display portion 2 containing characters, symbols, and the like was printed on the above-mentioned protective layer portion in vinyl chloride or vinyl acetate base colored ink, thereby forming a display layer 3. A base film 1, which was a 100 μm thick carbonate film comprising an adhesive layer 8 coated with acrylic adhesive compound, was laminated to that side where the display layer 3 was formed, thereby creating a film lamination. This film lamination was deformed to the shape of the key top by means of a mold for temporary drawing, and then was firmly held by means of a mold for injection molding. Thereafter, polycarbonate resin was injected onto the above-mentioned film lamination to produce a sheet-like key top in which five key top main bodies were formed. Thus was obtained a high-quality sheet-like key top having mirror finish characteristics, in which the display portion was not distorted and the display layer was not cracked.

Embodiment 3

Figure 1:
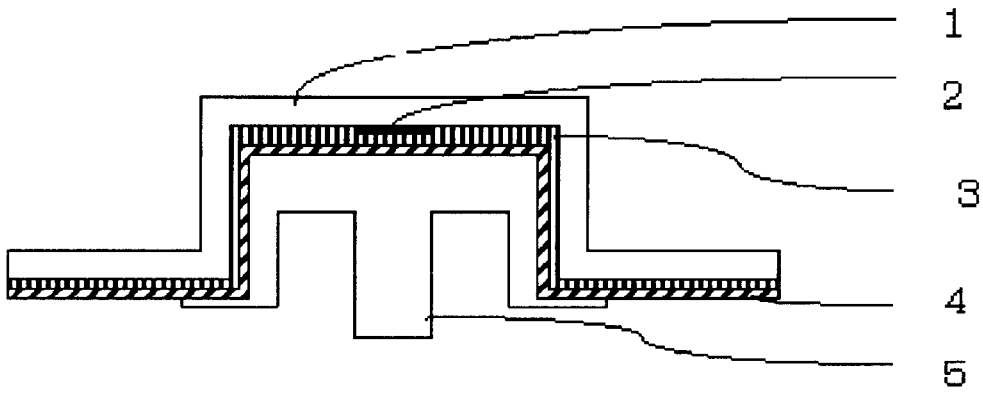
FIG. 1: (a) shows a longitudinal sectional view and (b) shows a top view of an embodiment of a sheet-like key top of the present invention.
Figure 1:
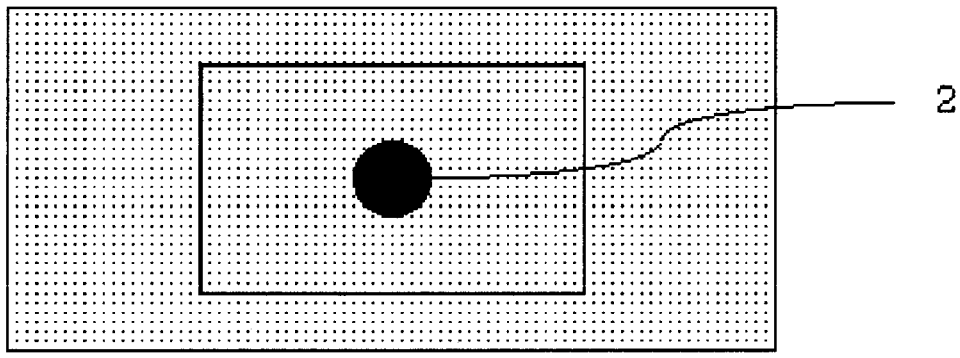
Figure 2:
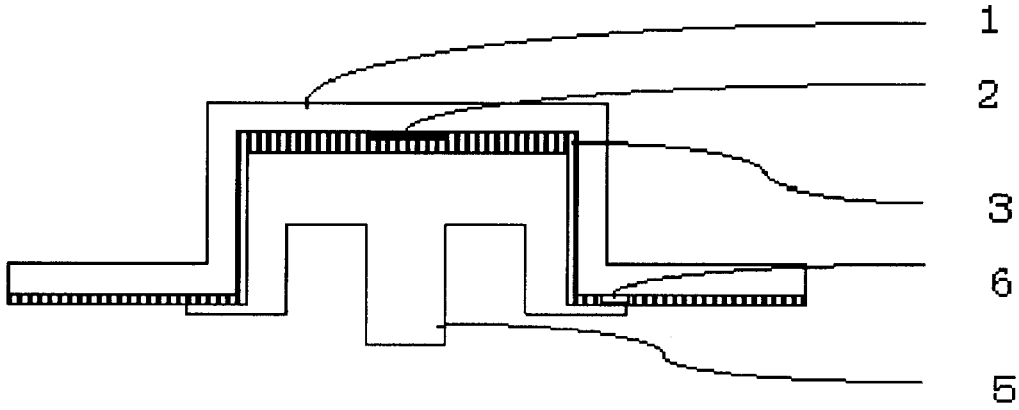
Fig. 2 PRIOR ART
FIG. 2: (a) shows a longitudinal sectional view and (b) shows a top view of a comparative example of a prior art sheet-like key.
Figure 2:
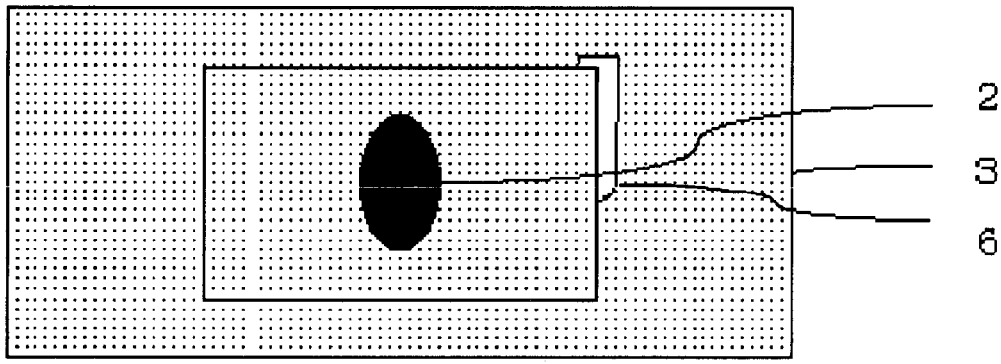
Fig. 2 PRIOR ART

As shown in FIG. 1, a circular display portion 2 was printed on one surface of a base film 1, which was a 100 μm thick carbonate film, in vinyl chloride or vinyl acetate base black shading ink, and then the whole printed surface of the above-mentioned display portion 2 was subjected to printing in metallic-looking ink to which vinyl chloride or vinyl acetate base aluminum powder was added, thereby forming a display layer 3. A protective film 4, which was a 20 μm thick PET film coated with acrylic adhesive compound, was laminated to that side where the display layer 3 was formed, thereby creating a film lamination. This film lamination was deformed to the shape of the key top by means of a mold for temporary drawing, and then was firmly held by means of a mold for injection molding. Thereafter, polycarbonate resin was injected onto the above-mentioned film lamination to produce a sheet-like key top in which five key top main bodies were formed. Thus was obtained a high-quality sheet-like key top, in which aluminum powder was not dispersed unevenly, the display portion was not distorted, and the display layer was not cracked.

According to the present invention, by laminating a protective film to the backside of a display layer, the pressure and the heat of molten resin which are generated during the forming of a key top consisting of thermoplastic resin are prevented from directly affecting the display layer, thereby making it possible to provide a high-yield, high-quality sheet-like key top in which the display portion is not distorted and the display layer is not cracked. Moreover, in the case of a metallic-looking display layer in which metal filler is mixed, uneven dispersion of the metal filler is eliminated.

Furthermore, in the case of a sheet-like key top is of the illumination type, if a transparent protective film is used, this protective film also serves effectively as a light-transmitting layer.

What is claimed is:

1. A key top, comprising:

a base film;

a display layer disposed on a backside of said base film;

a protective film laminated to a backside of the display layer to form a multilayer film lamination; and a key top main body, said multilayer film lamination being formed to a shape of an upper surface of said key top main body and being integrally attached to said main body.

2. A key top according to claim 1, wherein said base film has a back surface at least partially printed in black shading ink and with a non printed indicia portion and a display portion printed on at least a portion of said indicia portion in translucent ink, said black shading ink and said and said translucent ink forming said display layer.

3. A key top according to claim 2, wherein said film lamination is formed to a shape by a mold for temporary drawing, and subsequently held by a mold for injection molding in which a resin is injected onto the film lamination to produce the key top.

4. A key top according to claim 1, wherein a film layer is formed by deposition on a front side of said protective film and a protective layer is provided on said film layer, said display layer comprising an ink display portion printed on said protective layer at a protective layer side of said protective film, said display layer being disposed on said base film upon laminating said base film to said protective layer side of said protective film to form said film lamination.

5. A key top according to claim 4, wherein said film lamination is formed to a shape by a mold for temporary drawing, and subsequently held by a mold for injection molding in which a resin is injected onto the film lamination to produce the key top.

6. A key top according to claim 5, further comprising: a polycarbonate resin injected onto said film lamination.

7. A key top according to claim 1, wherein a display portion is printed on one surface of said base film in black shading ink, and a printed surface of said display portion is subjected to printing in metallic appearance ink to form said display layer with said protective film laminated to a display layer side of said base film to form said film lamination.

8. A key top according to claim 7, wherein said film lamination is formed to a shape by a mold for temporary drawing, and subsequently held by a mold for injection molding in which a resin is injected onto the film lamination to produce the key top.

9. A key top according to claim 8, further comprising: a polycarbonate resin injected onto said film lamination.

10. A sheet-like key top, formed by the steps of providing a base film;

disposing a display layer on a backside of said base film directly in contact with said base film;

laminating a protective film to a backside of the display layer to form a multilayer film lamination; and providing a key top main body, said multilayer film lamination being formed to a shape of an upper surface of said key top main body and being integrally attached to the main body.

11. A sheet-like key top according to claim 10, wherein said step of disposing said display layer on a backside of said base film includes at least partially printing at least a portion of said base film with black shading ink leaving a non printed indicia portion and printing a display portion on at least a portion of said indicia portion in translucent ink, wherein said black shading ink and said and said translucent ink forming said display layer.

12. A sheet-like key top according to claim 11, wherein said film lamination is formed to a shape by a mold for temporary drawing, and subsequently held by a mold for injection molding in which a resin is injected onto the film lamination to produce the key top.

13. A sheet-like key top according to claim 10, wherein a film layer is formed by deposition on a front side of said protective film and a protective layer is provided on said film layer, said display layer comprising an ink display portion printed on said protective layer at a protective layer side of said protective film, said display layer being disposed on said base film upon laminating said base film to said protective layer side of said protective film to form said film lamination.

14. A sheet-like key top according to claim 13, wherein said film lamination is formed to a shape by a mold for temporary drawing, and subsequently held by a mold for injection molding in which a resin is injected onto the film lamination to produce the key top.

15. A sheet-like key top according to claim 14, further comprising: a polycarbonate resin injected onto said film lamination.

16. A sheet-like key top according to claim 10, wherein a display portion is printed on one surface of said base film in black shading ink, and a printed surface of said display portion is subjected to printing in metallic appearance ink to form said display layer with said protective film laminated to a display layer side of said base film to form said film lamination.

17. A sheet-like key top according to claim 16, wherein said film lamination is formed to a shape by a mold for temporary drawing, and subsequently held by a mold for injection molding in which a resin is injected onto the film lamination to produce the key top.

18. A sheet-like key top according to claim 17, further comprising: a polycarbonate resin injected onto said film lamination.

19. A sheet-like key top, comprising:

a base film;

a display layer printed on a backside of said base film directly in contact with said base film;

a protective film laminated to a backside of the display layer to form a multilayer film lamination; and a key top main body, said multilayer film lamination being formed to a shape of an upper surface of said key top main body and being is integrally attached to the main body by injecting resin onto the film lamination to produce the key top.

* * * * *